United States Patent [19]

Kameda

[11] 4,418,136

[45] Nov. 29, 1983

[54] ELECTROPHOTOGRAPHIC ELEMENT COMPRISES ARSENIC SELENIDE DOPED WITH BI

[75] Inventor: Masahiro Kameda, Ibaragi, Japan

[73] Assignee: Ricoh Co., Ltd., Tokyo, Japan

[21] Appl. No.: 379,223

[22] Filed: May 17, 1982

[30] Foreign Application Priority Data

May 21, 1981 [JP] Japan ..... 56-76874

[51] Int. Cl.[3] ..... G03G 5/09

[52] U.S. Cl. ..... 430/95; 430/57

[58] Field of Search ..... 430/84, 95

[56] References Cited

U.S. PATENT DOCUMENTS 4,241,158 12/1980 Fukuda et al. ..... 430/86

FOREIGN PATENT DOCUMENTS 2856494 7/1979 Fed. Rep. of Germany ..... 430/86

*Primary Examiner*—J. D. Welsh

*Attorney, Agent, or Firm*—Flynn, Thiel, Boutell & Tanis

[57] ABSTRACT

An electrophotographic element comprising a photoconductive layer consisting essentially of a Bi-containing $As_2Se_3$ layer on an electrically conductive substrate.

12 Claims, 11 Drawing Figures

ELECTROPHOTOGRAPHIC ELEMENT COMPRISES ARSENIC SELENIDE DOPED WITH BI

BACKGROUND OF THE INVENTION (a) Field of the Invention

The present invention relates to a novel electrophotographic element.

(b) Description of the Prior Art

Electrophotographic elements comprising a photoconductive layer consisting of $As_2Se_3$ formed on an electrically conductive substrate such as Al drum or the like have hitherto been used. However, the conventional elements of this type are noted to be defective in that they are nearly insensitive to a long wavelength light of 800 nm or more.

SUMMARY OF THE INVENTION

The object of the present invention is to provide an electrophotographic element which is capable of maintaining the normal electric charge characteristics equivalent substantially to the $As_2Se_3$ monolayer as well as providing sensitivity to radiation of a broad range of long wavelengths, by incorporating Bi in an $As_2Se_3$ layer.

The term "$As_2Se_3$ layer" used herein means a layer consisting essentially of $As_2Se_3$ stoichiometrically, but includes those wherein these values "2" and "3" somewhat vary.

The present invention basically relates to an electrophotographic element comprising a photoconductive layer consisting essentially of a Bi-containing $As_2Se_3$ layer on an electrically conductive substrate. However, for the purpose of further improving the electric charge characteristics there may be provided one or two other chalcogen layer or layers for instance such as another photoconductive layer consisting of Se, Se+Te, Se+As (especially, $As_2Se_3$) or the like, on and/or under said $As_2Se_3$ layer (namely, between the $As_2Se_3$ layer and the substrate).

DETAILED DESCRIPTION OF THE INVENTION

Figure 1:
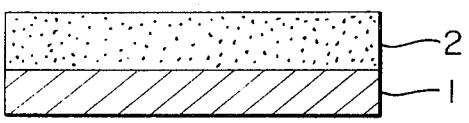
FIGS. 1 to 4 are sectional views illustrating the structures of embodiments of electrophotographic elements embodying the present invention.
Figure 2:
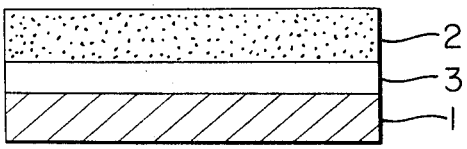
Figure 3:
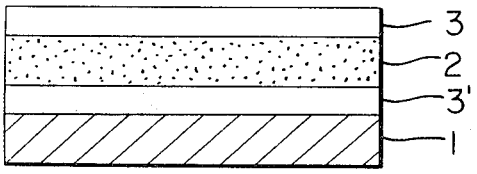
Figure 4:
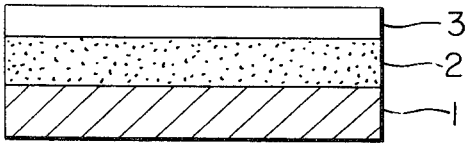

The basic construction of the electrophotographic element according to the present invention consists in overlaying a photoconductive layer comprising a Bi-containing $As_2Se_3$ layer (which will be referred to as a Bi-containing layer for short hereinafter) 2 on an electrically conductive substrate 1 as shown in FIG. 1. As the modified construction of the electrophotographic element according to the present invention there may be enumerated the one wherein a photoconductive layer comprising a Bi-containing layer 2 and another same or different chalcogen layer 3,3' is provided on an electrically conductive substrate 1 as shown in FIG. 2 to FIG. 4. In this instance, the quantity of Bi in the Bi-containing layer preferably is in the range of 0.1 to 2% by weight of this layer. In case said Bi content is less than 0.1% by weight, the Eg (optical band gap) caused by addition of Bi scarcely decreases, whereby a desired long wavelength sensitivity can not be obtained. In case the Bi content is in excess of 2% by weight, there is possibility of the occurrence of phase separation depending on the vapourdeposition conditions employed in the preparation of the electrophotographic element which lowers the charged potential extremely to thereby hamper the formation of image.

The overall thickness of said photoconductive layer preferably is in the range of about 30 to 80 $\mu$m. The preferable thickness of said Bi-containing layer is about 30 to 80 $\mu$m in the instance as shown in FIG. 1, and is about 0.1 to 78 $\mu$m in each instance as shown in FIG. 2 to FIG. 4. Accordingly, the preferable thickness of another chalcogen layer is in the range of 2 to 79.9 $\mu$m (wherein, in case the number of other chalcogen layers is two, said preferable thickness is the total thereof).

The electrophotographic element according to the present invention is sensitive to the broad range of long wavelengths, which phenomenon could not be observed in the conventional electrophotographic element comprising a layer consisting of $As_2Se_3$ only (said layer being referred as $As_2Se_3$ monolayer hereinafter). Such a high sensitivity is considered attributable to that Bi has a lower energy of ionization than As (the said energy of As is 9.81 eV, while that of Bi is 7.28 eV), and so when Bi is incorporated in the network of $As_2Se_3$ in place of As, its band gap is narrowed.

Figure 5:
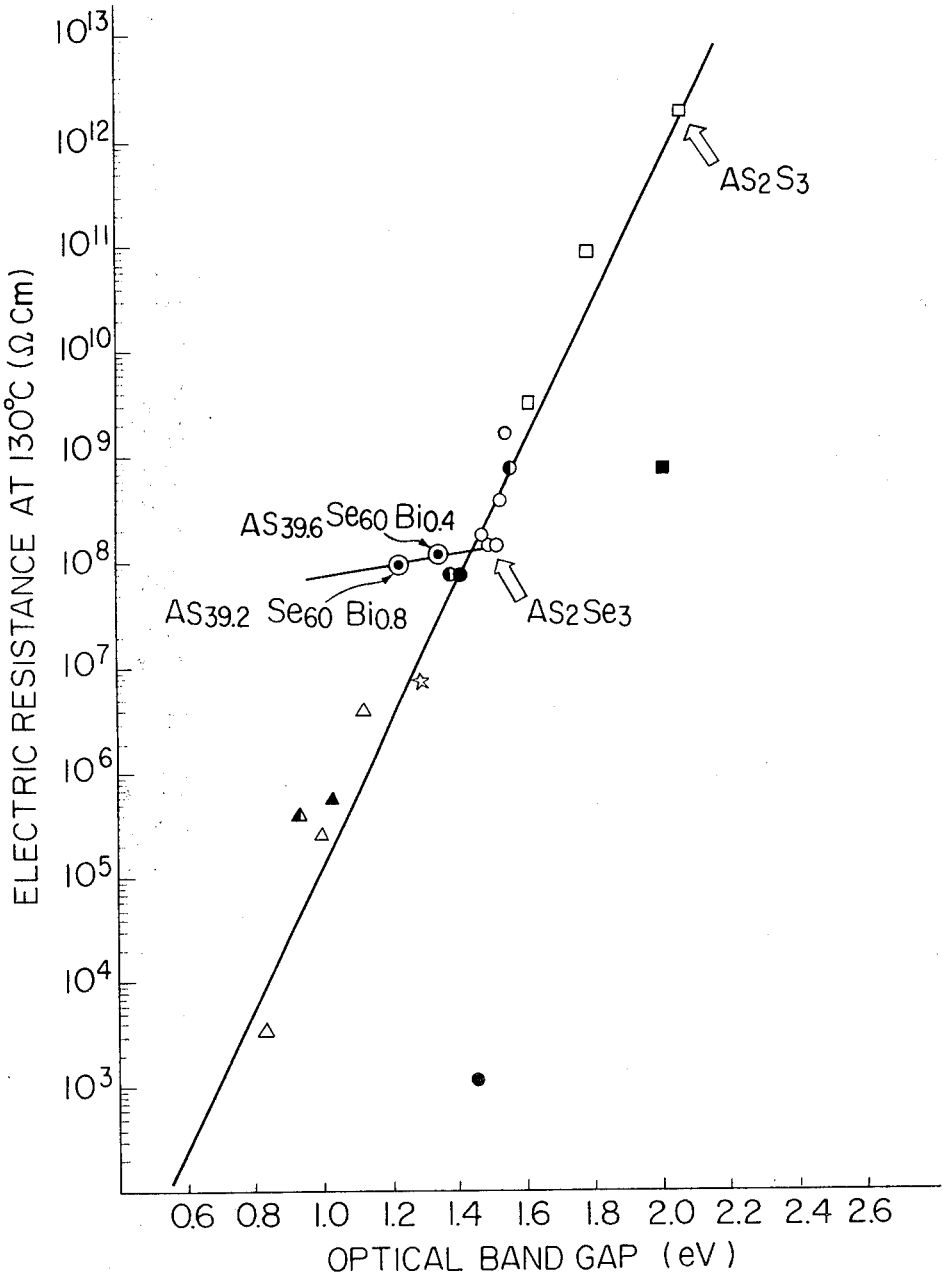
FIG. 5 is a view illustrating the relationship between the resistibility $\rho$ of system obtained by adding various kinds of third components to the base $As_2Se_3$ and the optical band gap Eg.

As is evident from the aforegoing, the present invention has raised the sensitivity of the $As_2Se_3$ layer by adding Bi thereto. Hereupon, this sensitivity may be raised by adding a third component other than Bi, for instance, such as Te or Sb. However, the addition of Te or Sb presents a new problem that the charged potential of the layer drops. In contrary, the addition of Bi is substantially free from the drop of charged potential and can maintain the electric charge characteristics substantially equivalent to those of the $As_2Se_3$ monolayer. The reason will be explained with reference to FIG. 5 wherein symbol ⊙ denotes the As-Se($As_2Se_3$)-Bi system layer according to the present invention, symbol ○ denotes an As-Se system layer, symbol ● denotes an As-Se-Ag system layer, symbol ◐ denotes an As-Se-Ge system layer, symbol △ denotes an As-Se-Te system layer, symbol ◭ denotes an As-Se-Te-Ag system layer, symbol ▲ denotes an As-Se-Te-Ge system layer, symbol ☆ denotes an As-Sb-Se system layer, symbol □ denotes an As-S ($As_2S_3$) system layer and symbol ■ denotes an As-S-Ag system layer respectively. As this figure clearly shows, when the third component other than Bi is added, the resistability $\rho$ of the system deteriorates rapidly in a linear relationship as the optical band gap Eg narrows. In other words, when the third component other than Bi is added there can be obtained a linear relationship regardless of the kind of third component that is added. This phenomenon implies that in the case of the layer using the third component other than Bi its charged potential drops rapidly as compared with the $As_2Se_3$ monolayer. In the case of the Bi-containing layer, contrarily, the resistability $\rho$ of system deteriorates in an extremely small degree against the narrowing degree of Eg. This means that the charged potential of the Bi-containing layer scarcely deteriorates as compared with the $As_2Se_3$ monolayer. In this regard, it is to be noted that the reason for this, although not clarified yet, is conjectured to be that in the case of the $As_2Se_3$+Bi layer there is not established the equation: (Activation energy of conductivity)=½ (optical band gap) which generally prevails in the amorphous chalcogen type or Nictide type semi-conductor.

In this connection, it is to be noted that the layer construction as shown in FIG. 1 is most superior in the respect of residual potential but is defective in that the charged potential somewhat drops. This defect can be prevented by employing the layer constructions as shown in FIG. 2 to FIG. 4.

A vacuum vapordeposition method is generally available for the preparation of the electrophotographic element according to the present invention. In the practice of said method, however, there is necessity of making ready two vapordeposition sources for use in $As_2Se_3$ and effecting vapordeposition on the electrically conductive substrate individually from these vapordeposition sources because the vapor pressure of Bi is extremely low as compared with that of As or Se. In this case, the suitable vapor source temperature under the degree of vacuum of $10^{-6}$ to $10^{-5}$ Torr is 350° to 420° C. with reference to $As_2Se_3$ and 600° to 800° C. with reference to Bi respectively. At any rate, in the case of the element as shown in FIG. 1, vapordeposition of $As_2Se_3$ and Bi is carried out simultaneously and continuously, while in the cases of the elements as shown in FIGS. 2 to 4 wherein for instance $As_2Se_3$ is used as another chalcogen, vapordeposition of Bi is carried out simultaneously for a proper period of time while vapordeposition of $As_2Se_3$ is carried out continuously, whereby the element according to the present invention can be obtained.

Examples of the present invention will be given hereinafter.

EXAMPLES

EXAMPLE 1

Figure 6:
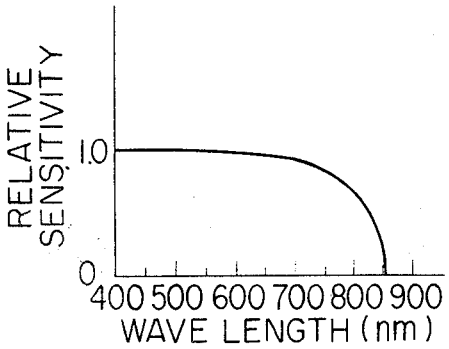
FIGS. 6 to 10 are graphs illustrating the relative spectral sensitivity of the electrophotographic elements obtained in Example 1 to Example 5 of the present invention.
Figure 11:
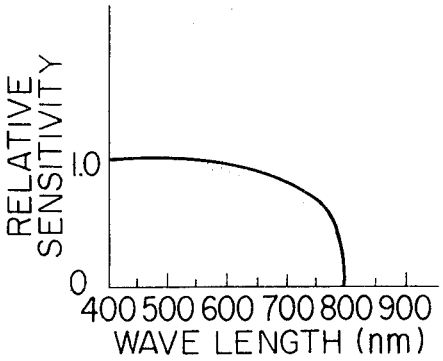
FIG. 11 is a graph illustrating the relative spectral sensitivity of the control electrophotographic element prepared in Example 1.

$As_2Se_3$ and Bi were placed in two vapordeposition sources individually. First, the $As_2Se_3$ heated to 400° C. was vapordeposited on an Al drum under the degree of vacuum of $2\times10^{-4}$ Torr for 25 minutes. On the other hand, the Bi heated to 700° C. was vapordeposited simultaneously on said Al drum for 10 minutes. from the Bi source after the lapse of 15 minutes from the start of vapordeposition of $As_2Se_3$. Thus, the electrophotographic element of the type as shown in FIG. 2 was prepared. In this instance, a film thickness-watching means was installed just above the Bi vapordeposition source to watch the thickness of a Bi-containing layer to be formed. However, the accurate thickness and Bi content were measured by means of XMA (X-ray Micro Analyzer) after the completion of vapordeposition. The overall photoconductive layer thus prepared was 60 μm-thick. The outside Bi-containing layer thereof was 10 μm-thick. The Bi content of the Bi-containing layer was 0.5% by weight of the Bi-containing layer. And, the spectral sensitivity of the electrophotographic element covered 860 nm (which see FIG. 6) and extended toward the long wavelength side by 60 nm as compared with the spectral sensitivity of 800 nm (which see FIG. 11) of a control electrophotographic element comprising as $As_2Se_3$ monolayer (which was prepared according to the exactly same precedure of the instant example except that Bi was not vapordeposited.)

Further, the element of the present invention and the control element were each subjected to 20 seconds'+6KV corona discharge in the dark by means of a commercially available paper analyzer and charged. The charged potential $V_M$ at that time was measured with reference to both electrophotographic elements. Subsequently, both electrophotographic elements were left standing for 20 seconds and their potential was measured again to calculate their potential retaining coefficient $R_D$ during said 20 seconds. Thereafter, both electrophotographic elements were further subjected to radiation of 10 lux white light to measure their potential (residual potential) $V_R$ after the lapse of 20 seconds. The thus obtained results are: $V_M$=1100 V, $R_D$=0.62 and $V_R$=50 V in the electrophotographic element of the present invention and $V_M$=1250 V, $R_D$=0.71 and $V_R$=1 V in the control electrophotographic element. Between the results there was observed no substantial difference except for $V_R$.

EXAMPLE 2

Figure 7:
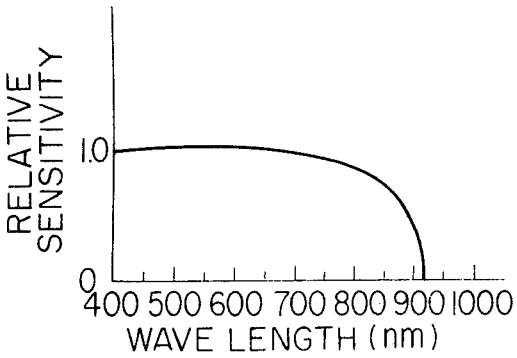

An electrophotographic element was prepared by repeating the exactly same procedure as Example 1 except that the Bi vapordeposition source was heated to 750° C. In the case of this electrophotographic element, the Bi content in the Bi-containing layer was 1.0% by weight of the Bi-containing layer. Further, the spectral sensitivity was observed to cover 920 nm (which see FIG. 7). In addition, this electrophotographic element showed the results: $V_M$=900 V, $R_D$=0.53 and $V_R$=60 V.

EXAMPLE 3

Figure 8:
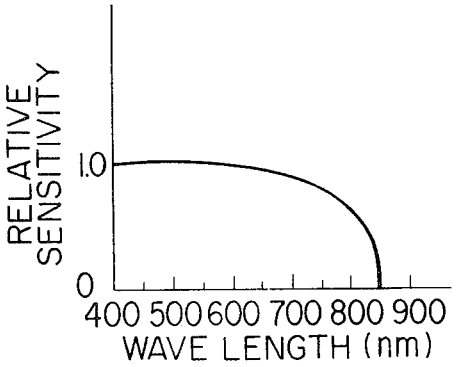

An electrophotographic element of the type as shown in FIG. 3 was prepared by repeating the exactly same procedure as Example 1 except that the Bi-vapordeposition was carried out for 10 minutes after the lapse of 10 minutes from the start of vapordeposition of $As_2Se_3$. In the case of this electrophotographic element, the Bi content in the Bi-containing layer and the thickness of the Bi-containing layer were the same as those in Example 1, but the sensitivity, covered 850 nm (which see FIG. 8). In addition, this electrophotographic element showed the results: $V_M$=1200 V, $R_D$=0.65 and $V_R$=60 V.

EXAMPLE 4

Figure 9:
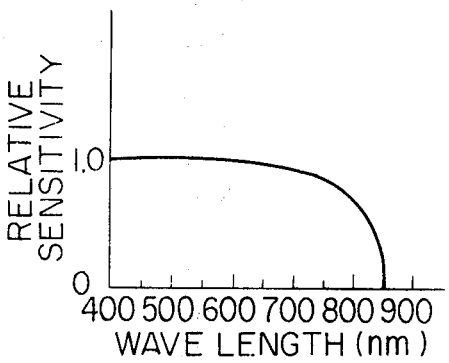

An electrophotographic element of the type as shown in FIG. 4 was prepared by repeating the exactly same procedure as Example 1 except that the Bi-vapordeposition was carried out for 10 minutes simultaneously with the start of vapordeposition of $As_2Se_3$. In the case of this electrophotographic element, the Bi content in the Bi-containing and the thickness of the Bi-containing layer were the same as those in Example 1, but the sensitivity covered 850 nm (which see FIG. 9). In addition, this electrophotographic element showed that the results: $V_M$=1200 V, $R_D$=0.67 and $V_R$=40 V.

EXAMPLE 5

Figure 10:
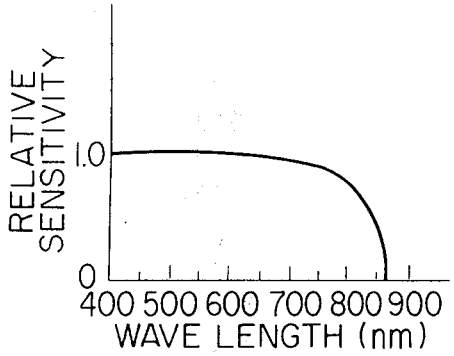

An electrophotographic element of the type as shown in FIG. 1 was prepared by vapordepositing Bi on an Al drum at the temperature and degree of vacuum described in Example 1 for 40 minutes simultaneously with the vapordeposition of $As_2Se_3$. In the case of this electrophotographic element, the Bi content in the Bi-containing layer was 1.0% by weight, the thickness of the Bi-containing layer was 60 μm, and the sensitivity covered 860 nm (which see FIG. 10). In addition, this electrophotographic element showed the results: $V_M=700$ V, $R_D=0.63$ and $V_R=5$ V.

What is claimed is:

1. An electrophotographic element comprising an electrically conductive substrate and a first photoconductive layer on said substrate, said first photoconductive layer consisting essentially of $As_2Se_3$ containing an amount of Bi metal effective to extend the sensitivity of the $As_2Se_3$ to include sensitivity to radiation having a wavelength longer than 80 nm, the amount of Bi metal also being effective to maintain the electric charge characteristics of said first photoconductive layer substantially equivalent to those of a layer consisting of $As_2Se_3$.

2. An electrophotographic element as claimed in claim 1 wherein the Bi content is in the range of 0.1 to 2% by weight of said first photoconductive layer.

3. An electrophotographic element as claimed in claim 1 in which said first photoconductive layer is the sole photoconductive layer on said substrate.

4. An electrophotographic element as claimed in claim 3 wherein said first photoconductive layer has a thickness of 30 to 80 μm.

5. An electrophotographic element as claimed in claim 1 including one or two additional photoconductive layers.

6. An electrophotographic element as claimed in claim 5 wherein each of said additional photoconductive layers consists of an $As_2Se_3$ layer.

7. An electrophotographic element as claimed in claim 5 in which there is one additional photoconductive layer, and said first photoconductive layer and said additional photoconductive layer are superimposed in that order on said electrically conductive substrate.

8. An electrophotographic element as claimed in claim 7 wherein the total thickness of the two photoconductive layers is from 30 to 80 μm, the first photoconductive layer is 0.1 to 78 μm, thick, and the additional photoconductive layer is 2 to 79.9 μm thick.

9. An electrophotographic element as claimed in claim 5 in which there is one additional photoconductive layer, and said additional photoconductive layer and said first photoconductive layer are superimposed in that order on said electrically conductive substrate.

10. An electrophotographic element as claimed in claim 9 wherein the total thickness of the two photoconductive layers is from 30 to 80 μm, said additional photoconductive layer is 2 to 79.9 μm thick and said first photoconductive layer is 0.1 to 78 μm.

11. An electrophotographic element as claimed in claim 5 in which there are two additional photoconductive layers which are disposed on opposite sides of said first photoconductive layer.

12. An electrophotographic element as claimed in claim 11 wherein the total thickness of the three photoconductive layers is from 30 to 80 μm, the combined thicknesses of the two additional photoconductive layers is 2 to 79.9 μm, and the thickness of said first photoconductive layer is 0.1 to 78 μm.

* * * * *